US012013210B2

(12) United States Patent
Lv

(10) Patent No.: US 12,013,210 B2
(45) Date of Patent: Jun. 18, 2024

(54) AUXILIARY OPTICAL SYSTEM

(71) Applicant: SHENZHEN GONGFENXIANG NETWORK TECHNOLOGY CO., LTD., Shenzhen (CN)

(72) Inventor: Liang Lv, Shenzhen (CN)

(73) Assignee: SHENZHEN GONGFENXIANG NETWORK TECHNOLOGY CO., LTD., Shenzhen (CN)

( * ) Notice: Subject to any disclaimer, the term of this patent is extended or adjusted under 35 U.S.C. 154(b) by 119 days.

(21) Appl. No.: 18/054,150

(22) Filed: Nov. 10, 2022

(65) Prior Publication Data

US 2023/0080906 A1 Mar. 16, 2023

Related U.S. Application Data

(63) Continuation of application No. PCT/CN2021/132962, filed on Nov. 25, 2021.

(30) Foreign Application Priority Data

Sep. 28, 2020 (CN) ..... 202011042978.6

(51) Int. Cl.
*F41G 1/16* (2006.01)

(52) U.S. Cl.
CPC ..... *F41G 1/16* (2013.01)

(58) Field of Classification Search
CPC ..... F41G 1/16
USPC ..... 235/404
See application file for complete search history.

(56) References Cited

U.S. PATENT DOCUMENTS

2014/0259853 A1 9/2014 Crispin

FOREIGN PATENT DOCUMENTS

| | | | |
|---|---|---|---|
| CN | 201093943 | Y | 7/2008 |
| CN | 101900514 | A | 12/2010 |
| CN | 202372698 | U | 8/2012 |
| CN | 202793181 | U | 3/2013 |
| CN | 103673764 | A | 3/2014 |
| CN | 103676131 | A | 3/2014 |
| CN | 109425261 | A | 3/2019 |
| CN | ON 112179209 | A | 1/2021 |

OTHER PUBLICATIONS

International Search: Report for PCT/CN2021/132962.

*Primary Examiner* — Daniel A Hess

(57) ABSTRACT

An auxiliary optical system is installed on a telescopic sight of a gun, the telescope sight including an eyepiece end, an objective end and a first reticle. The system includes a digital imaging member fixed at the objective end by a first fixing member and partially shielding an objective lens, a display member fixed at the eyepiece end by a second fixing member and electrically connected to the digital imaging member; the digital imaging member configured to perform photosensitive image on environmental images and convert the environmental images into video signals, and generates a second reticle that is adjustable and has the same function as the first reticle, the second reticle and the video signals stacked together to be transmitted to the display member for display. The present disclosure enables the gun to have functions of the digital sight without replacing a conventional telescopic sight.

9 Claims, 6 Drawing Sheets

AUXILIARY OPTICAL SYSTEM

BACKGROUND

1. Technical Field

The present disclosure generally relates to the field of auxiliary optical systems, and especially relates to an auxiliary optical system used for a telescopic sight of a gun.

2. Description of Related Art

Gun sights, especially conventional telescopic sights, since its invention, has been widely used in sports, hunting and military activities for their accuracy to hit a target. With the progress of science and technologies, various digital sights that are imaged by photosensitive chips have emerged, such as night vision, thermal imaging and other digital sights that are imaged by the photosensitive chips; compared with these above digital sights, a conventional telescopic sight has absolute advantages in aspects of reliability, stability, accuracy and long range clarity, but with the progress of time, the conventional telescopic sight has obvious disadvantages in an aspect of application under special environmental conditions, such as low-illumination conditions.

In order to achieve an aiming function under the low-illumination conditions such as at night, the night vision sights, the thermal imaging sights and other digital sights that are imaged by photosensitive chips are usually preferred. To replace a conventional telescopic sight by the digital sight, the conventional telescopic sight first needs to be detached from the gun, and the digital sight is installed, and then the digital sight that has been installed on the gun will be sighted in. The sighting in is aligning the guan sights on your rifle so a bullet hits where you aim (usually with a crosshair center) at a certain distance, because the bullet travels in an arced trajectory formed by the pull of gravity, at this specific distance, a point that a trajectory of the bullet coincides with the aimpoint is called as a zero point, the distance is called as a zero distance, and the aiming line through a crosshair of a sight to reach the aimpoint of a target is called as a line of sight or a sighting line. Since the sighting in requires the bullet to hit the aimpoint at the zero distance, a shooter needs to accurately measure the zero distance, and then a target is placed at the zero distance, make sure that the environment is windless, and shoot at the target by placing the gun on a gun pod or a shooting pillow and adjust the telescopic sight according to the point of impact, and repeat this process several times to achieve the sighting in. It is a complicated process because if there is a small deviation when sighting in, a greater deviation will occur in shooting, and the sighting in process through shooting and adjusting can't be performed by in all environments, as when hunting requires silence kept quietly, battlefield with enemy at sight or in windy conditions, therefore, sighting in is a process that the shooter tries to avoid once it is done. Once the sighting in is completed at the zero distance, it is necessary to calculate an arced trajectory of the bullet according to ballistic characteristics, and then adjust the telescopic sight to hit the target accurately at other distances. A scope height, or a distance between a line of sight of the telescopic sight and a central line of a bore is one of the most important data for calculating the ballistic trajectory. In most of the cases, the conventional telescopic sight is replaced by the digital sight has a different scope height, if the shooter wants to achieve a good accuracy, the scope height of the digit sight must be measured and the ballistic trajectory curve is calculated by using the new scope height of the digit sight, this is also a complicated process. Meanwhile, because the conventional telescopic sight has absolute advantages in reliability, stability, accuracy and long range clarity in the daytime, it is necessary to replace the digital sight with the conventional telescopic sight, and a displacement can easily occur after the digital sight is replaced by the conventional telescopic sight, then it is necessary to re-perform the sighting in process, it is obviously not convenient to switch the sights frequently and then repeat the sighting in process frequently; if choose to add the digital sight above the conventional telescopic sight instead of replacing the sight, this will greatly increase an area of a contour line in a front view direction of the gun, which plays a great role in whether a gun is convenience to use, so adding the digital sight above increases the area of the contour line in the front view direction of the gun thus make it inconvenient to use, or even cause damage when bump into other objects; if it is selected to add the digital sight in front of the conventional telescopic sight, the sight of the conventional telescopic sight is completely blocked, and sighting in difficulty is increased greatly. Therefore, the conventional telescopic sight can't be used under the low-illumination conditions, and it is complicated and inconvenient to use the digital sight under the low-illumination conditions.

SUMMARY

The technical problems to be solved: in view of the shortcomings of the related art, the present disclosure provides an auxiliary optical system which can be quickly and conveniently used, and can be quickly installed on a conventional telescopic sight, so that a gun can have a function of the digital sight for aiming under special environmental conditions such as low-illumination conditions without replacing the conventional telescopic sight, and can be quickly sighted in without live ammunition shooting, meanwhile, an area of a contour line of a front view direction of the gun can be greatly reduced without the digital sight protruding on the conventional telescopic sight by providing a partial overlapping design, which is convenient to use and improves efficiency of use thereof.

The technical solution adopted for solving technical problems of the present disclosure is:

- an auxiliary optical system according to an embodiment of the present disclosure is installed on a telescopic sight of a gun, the telescopic sight including an eyepiece end, an objective end and a first reticle seen from the eyepiece end, an eyepiece installed on the eyepiece end, and an objective lens installed on the objective end;
- the auxiliary optical system including a digital imaging member, a display member, a first fixing member and a second fixing member, the digital imaging member fixed at the objective end by the first fixing member and partially shielding the objective lens, so that the digital imaging member and the objective end are partially overlapped in a line of sight direction of the telescopic sight;
- the display member fixed at the eyepiece end by the second fixing member and electrically connected to the digital imaging member, the display member including a display screen; and
- the digital imaging member configured to perform photosensitive imaging on an environmental image and convert the environmental image into a video signal, generate a second reticle that is adjustable and has the same function as the first reticle, and stack the second reticle with the video signal and then transmit to the display member for display.

Wherein an adjustment value of the second reticle is the same as that of the first reticle.

Wherein an aiming position of a target at a certain distance corresponding to a point of the second reticle coincides with an aiming position of the target at the same distance corresponding to the same point of the first reticle.

Wherein the first fixing member includes a first fixing ring, a second fixing ring and an overlapping cover, the first fixing ring installed on the objective end of the telescopic sight, the digital imaging member mounted in the second fixing ring, one surface of the overlapping cover connected to an outer edge portion of the first fixing ring and partially shielding an inner ring of the first fixing ring, so as to partially shielding the objective lens of the telescopic sight, and the other surface of the overlapping cover connected to the second fixing ring, so that the digital imaging member and the objective end of the telescopic sight are partially overlapped in the line of sight direction of the telescopic sight.

Wherein the digital imaging member further includes a lens, a housing, a key, a photosensitive module, an on screen display module and a power supply module;

all the photosensitive module, the on screen display module and the power supply module arranged in the housing, the lens arranged at a front end of the housing, and the key arranged on the housing;

the photosensitive module including a photosensitive chip, the lens configured to image the environment image on the photosensitive chip of the photosensitive module, and the photosensitive module configured to convert the environment image sensed by the photosensitive chip into the video signal and transmit to the on screen display module;

the key configured to perform setup selection on the on screen display module and input data to the on screen display module;

the on screen display module including a setting program for setting and configured to calculate input data according to the video signal and characteristics of the display screen of the display member, generate the second reticle that is adjustable, and stack the second reticle on the video signal to be transmitted to the display member; and the power supply module configured to provide power for both the digital imaging member and the display member.

Wherein the on screen display module is configured to calculate the number of pixels on the display screen corresponding to an adjustment value of each grid of the first reticle of the telescopic sight through an adjustment range of the first reticle of the telescopic sight, and generate the second reticle with the same adjustment value as the first reticle of the telescopic sight on the display screen, the second reticle having the same adjustment value as that of the first reticle of the telescopic sight.

Wherein the on screen display module determines a parallel aimpoint on the display screen through center distances between the objective end of the telescopic sight and the lens of the digital imaging member in a horizontal direction and in a vertical direction, the parallel aimpoint is a pixel point of the display screen of the display member corresponding to a sighting line of the lens of the digital imaging member, and the sighting line of the lens of the digital imaging member corresponding to the pixel point is parallel to a sighting line of a crosshair center of the first reticle of the telescopic sight.

Wherein the on screen display module is configured to automatically compensate and generate the second reticle by moving the parallel aimpoint that is on the display screen in horizontal and vertical directions, respectively, by a compensation value corresponding to an input distance of target.

Wherein an automatic compensation process includes:

calculating, by the on screen display module, values of the number of pixels on the display screen corresponding to a center distance between the objective end of the telescopic sight and the lens of the digital imaging member in the horizontal direction, and a center distance between the objective end of the telescopic sight and the lens of the digital imaging member in the vertical direction, according to the input distance of target; and moving the parallel aimpoint respectively in the horizontal direction and the vertical direction by the values of the number of pixels that have been calculated, to a position of a new pixel point, and generating the second reticle with the same adjustment value as the first reticle of the telescopic sight on the display screen by taking the new pixel point as a crosshair center, an aiming position of each point on the second reticle corresponding to the lens of the digital imaging member at the distance of target, and an aiming position of the same point on the first reticle of the telescopic sight at the same distance of target coincide with each other.

Wherein the display member is rotationally connected to the second fixing member to fold or unfold the display member.

The auxiliary optical system of the present disclosure can greatly reduce an area of the digital imaging member protruding on a contour line of a front view direction of a gun by providing a partial overlapping design of the digital imaging member and the objective lens of the telescopic sight, meanwhile, by setting the digital imaging member and the display member, the gun provided with the auxiliary optical system of the present disclosure can have an aiming function of the digital sight under special environmental conditions such as low-illumination conditions without replacing the conventional telescopic sight, can be silently sighted in in windy or windless environments without live ammunition shooting, can quickly complete adjustment, can allow the shooter to use the same ballistic trajectory calculation as the telescopic sight and using the same aimpoint as the reticle of the telescopic sight for shooting, can be quickly disassembled after being used, and greatly improves convenience and efficiency of use thereof.

DETAILED DESCRIPTION

Figure 1:
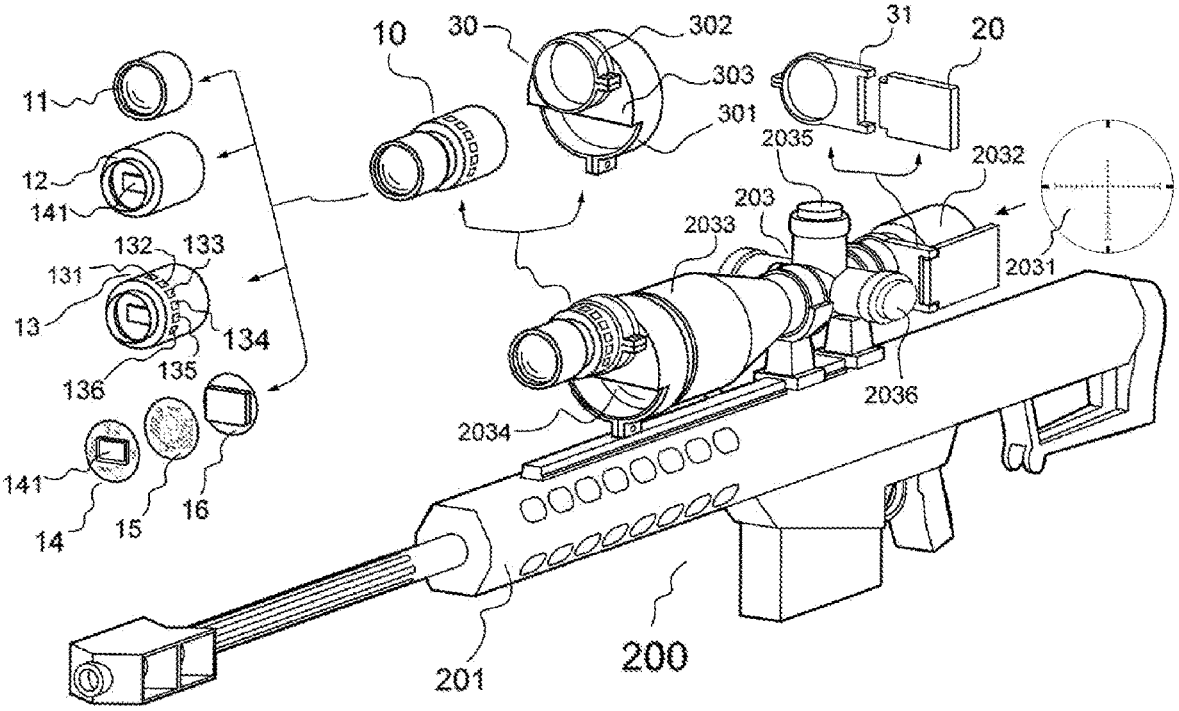
FIG. 1 is a schematic view of an auxiliary optical system installed on a telescopic sight of a gun in accordance with an embodiment of the present disclosure.

Reference will now be made in detail to embodiments, examples of which are illustrated in the accompanying drawings. The same or similar reference numerals throughout indicate the same or similar elements or elements with the same or similar functions. The embodiments described below with reference to the accompanying drawings are illustrative and intended to be used to explain the present disclosure, rather than being construed as a limitation of the present disclosure.

Referring to FIG. 1 to FIG. 5, an auxiliary optical system of the present disclosure is provided and installed on a telescopic sight 203 of a gun 200. The telescopic sight 203 includes an eyepiece end 2032, an objective end 2033 and a first reticle 2031 seen from the eyepiece end 2032, an eyepiece 2037 installed on the eyepiece end 2032, and an objective lens 2034 installed on the objective end 2033. The telescopic sight 203 of the present disclosure is installed on a body 201 of the gun 200, and at the same time, the telescopic sight 203 is provided with a windage turret 2035 and an elevation turret 2036.

The auxiliary optical system of the present disclosure includes a digital imaging member 10, a display member 20, a first fixing member 30 and a second fixing member 31, the digital imaging member 10 fixed at the objective end 2033 by the first fixing member 30 and partially shielding the objective lens 2034, so that the digital imaging member 10 and the objective end 2033 are partially overlapped in a line of sight direction of the telescopic sight 203. The present disclosure is provided that an area of the digital imaging member 10 protruding on a contour line of a front view direction of the gun 200 can be greatly reduced by setting a partial overlapping design, thus avoiding great inconvenience brought to use the gun that is caused by the area protruding on the contour line, and avoiding bumping into other objects and damaging. By experiments and observation, when the objective lens 2034 of the telescopic sight 203 in an embodiment of the present disclosure is blocked by two-thirds or more, the telescopic sight 203 can still be used to calibrate the digital imaging member 10. It can be seen that the above overlapping design reduces the area of the digital imaging member 10 protruding on the contour line of the front view direction of the gun 200, which is a very effective design.

The display member 20 includes a display screen 21, and is fixed on the eyepiece end 2032 through the second fixing member 31 and electrically connected with the digital imaging member 10, such electrical connection can be a wired or wireless connection.

Figure 5:
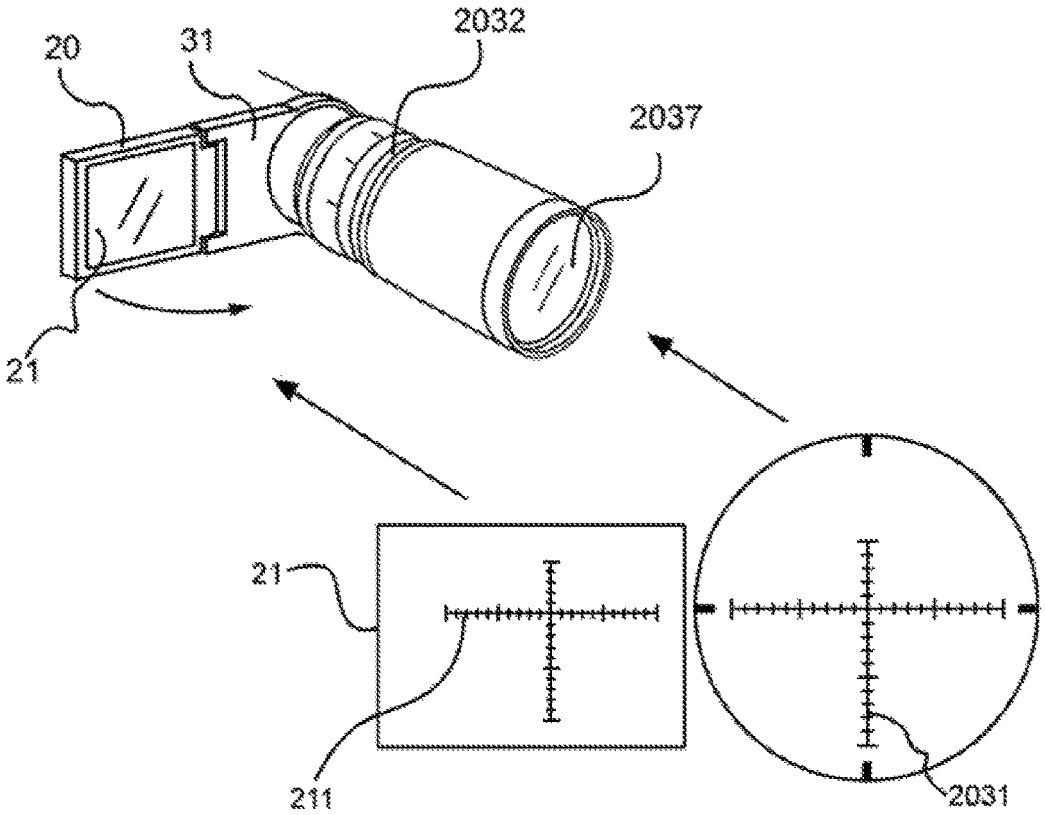
FIG. 5 is a schematic view of a display member of the auxiliary optical system of the present disclosure.

The digital imaging member 10 of the present disclosure is configured to perform photosensitive imaging on an environmental image and convert the environmental image into a video signal, generate a second reticle 211 that is adjustable and has the same function as the first reticle 2031; the digital imaging member 10 is further configured to stack the second reticle 211 with the video signal and then transmit to the display member 20 for display, which is shown in FIG. 5

That is, the second reticle 211 that has been generated has the same aiming and adjustment functions as the first reticle 2031, so that the shooter can directly use the second reticle 211 on the display screen 21 to aim at the target.

The digital imaging member 10 can accurately aim at the target under special environmental conditions such as low-illumination conditions, so that the auxiliary optical system of the present disclosure can let the gun 200 obtain the functions of a digital sight by adding onto the telescopic sight without replacing the telescopic sight; meanwhile, the auxiliary optical system of the present disclosure can be silently sighted in in windy or windless environments without live ammunition shooting, complete adjustment quickly, and allow a shooter to use the same ballistic trajectory calculation as the telescopic sight and use the same aimpoint as the reticle of the telescopic sight for shooting, can be quickly disassembled after being used; furthermore, the auxiliary optical system of the present disclosure can greatly reduce the area of the digital imaging member protruding on the contour line of the front view direction of the gun by partially overlapping the digital imaging member and the objective lens of the telescopic sight, which can greatly improve convenience and efficiency of use thereof.

Preferably, in an embodiment of the present disclosure, the display member 20 and the second fixing member 31 are rotationally connected with each other to fold or unfold the display member 20, thereby the area protruding on the contour line of the front view direction of the gun 200 can be reduced.

The display member 20 is folded close to and parallel to the eyepiece end 2032 of the telescopic sight 203 when the auxiliary optical system is non-use, and opened to a position perpendicular to the eyepiece end 2032 when the auxiliary optical system is used.

It is understood that in practical applications, the display member 20 can be fixed at other positions by other ways as long as the display screen 21 of the display member 20 is easy to be seen when the telescopic sight 203 is used for aiming.

It is understood that in practical applications, the digital imaging member 10 of the present disclosure can be installed at any position of the objective end 2033 and partially shield the objective lens 2034 of the objective end 2033.

Preferably, the digital imaging member 10 of the present disclosure is installed above and perfectly aligned vertically with the objective end 2033 and partially shields the objective lens 2034 at the objective end 2033, so as to prevent the digital imaging member 10 from projecting on left or right contour lines of the gun 200 to affect the usage of the digital imaging member 10.

Preferably, in an embodiment of the present disclosure, an adjustment value of the second reticle 211 is the same as that of the first reticle 2031. That is, an adjustment range of the second reticle 211 is the same as that of the first reticle 2031, and the adjustment value corresponding to each grid is the same.

Furthermore, an aiming position of a distance of target corresponding to a point of the second reticle 211 coincides with an aiming position of the target at the same distance of target corresponding to the same point of the first reticle 2031. That is, the aiming position at a distance of target to a point of the first reticle 2031 is the same position at the same distance of target to a corresponding point seen on the second reticle 211, that is a corresponding point on both reticles are aiming at the same target position, so that the shooter can directly use the second reticle 211 on the display screen 21 to aim at the target, which is convenient for the shooter to use.

Meanwhile, since the aiming positions of the first reticle 2031 and the second reticle 211 are coincide with each other, the digital imaging member 10 is automatically sighted in as long as the telescopic sight 203 is sighted in.

Figure 2:
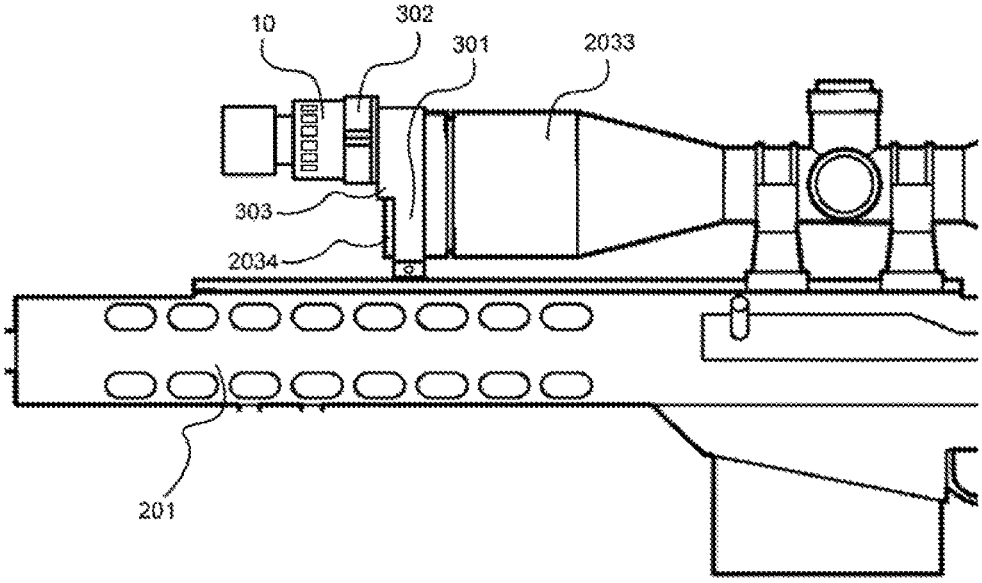
FIG. 2 is a partial side view of the auxiliary optical system of FIG. 1.
Figure 3:
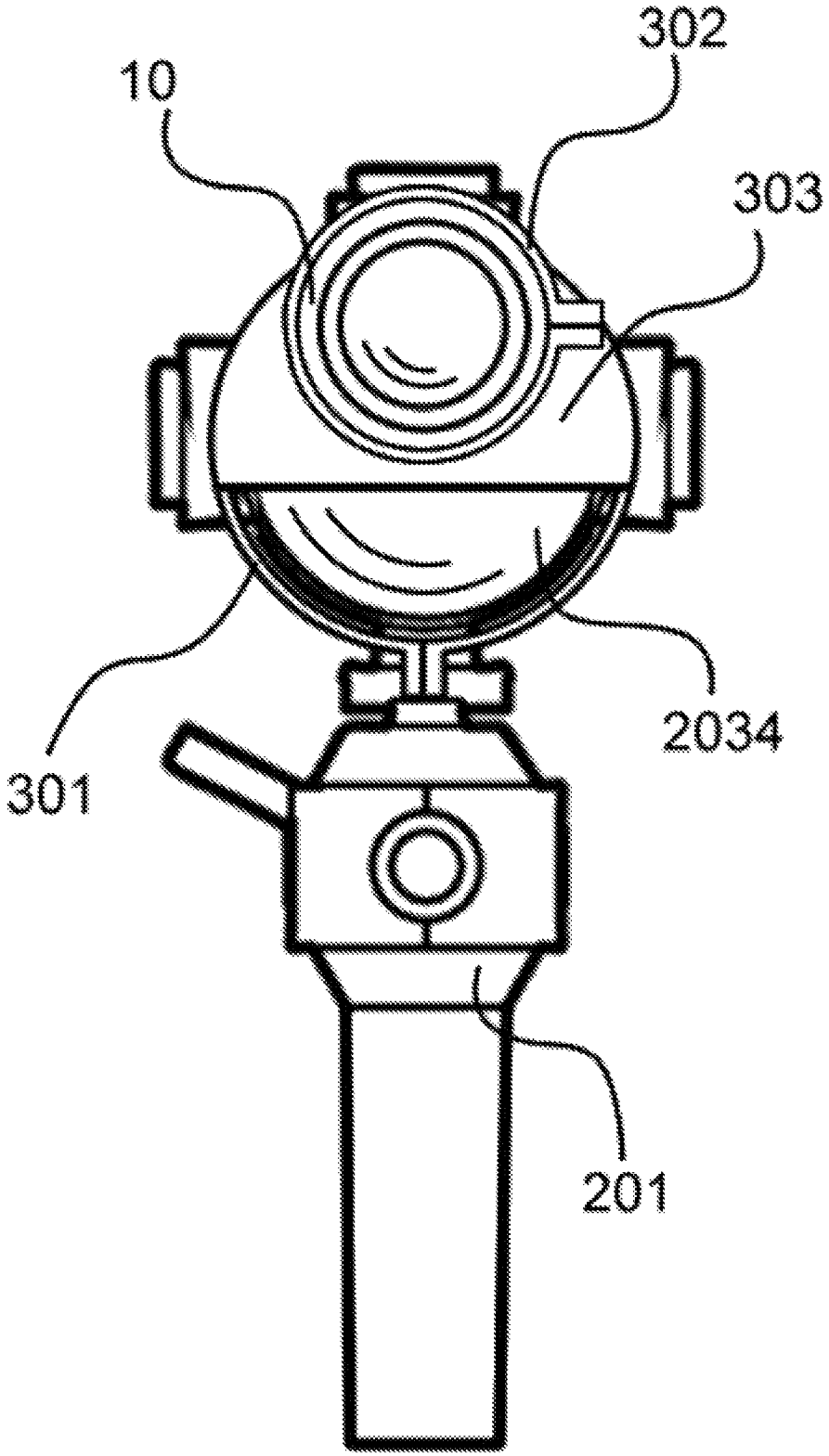
FIG. 3 is a front view of the auxiliary optical system of FIG. 1.

Specifically, referring to FIG. 1 and FIG. 2, the first fixing member 30 of the present disclosure includes a first fixing ring 301, a second fixing ring 302 and an overlapping cover 303, the first fixing ring 301 installed on the objective end 2033 of the telescopic sight 203, the digital imaging member 10 mounted in the second fixing ring 302, one surface of the overlapping cover 303 connected to an outer edge portion of the first fixing ring 301 and partially shielding an inner ring of the first fixing ring 301, so as to partially shielding the objective lens 2034 of the telescopic sight 203, and the other surface of the overlapping cover 303 connected to the second fixing ring 302, so that the digital imaging member 10 and the objective end 2033 of the telescopic sight 203 partially overlapped in a line of sight direction of the telescopic sight 203. In this way, the area of the digital imaging member 10 protruding on the contour line of the front view direction of the gun 200 can be greatly reduced, and inconvenience of use and damage by collision with other objects easily can be avoided.

Referring to FIG. 1, the digital imaging member 10 of the present disclosure includes a lens 11, a housing 12, a key 13, a photosensitive module 14, an on screen display module 15 and a power supply module 16.

All of the photosensitive module 14, the on screen display module 15 and the power supply module 16 are arranged in the housing 12, the lens 11 arranged at a front end of the housing 12, and the key 13 arranged on the housing 12.

Figure 4:
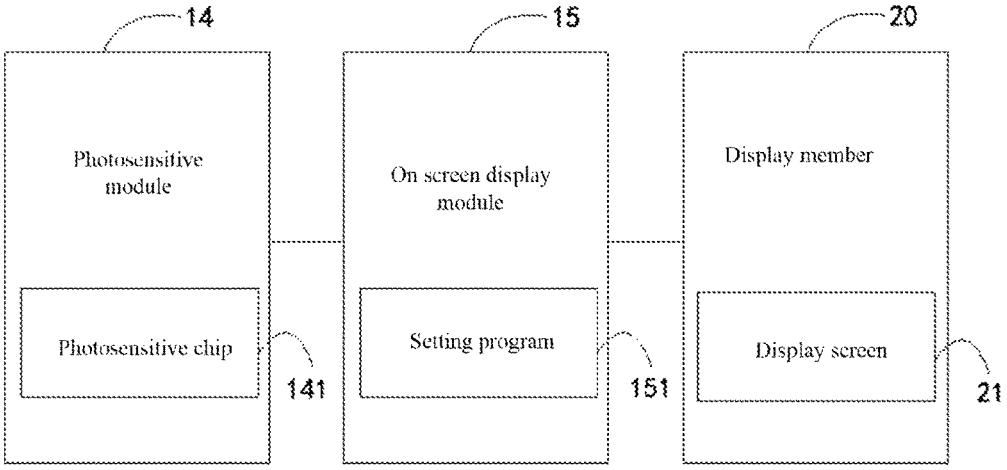
FIG. 4 is a block diagram of modules of the auxiliary optical system of the present disclosure.

The photosensitive module 14 includes a photosensitive chip 141, the lens 11 configured to image the environment image on the photosensitive chip 141 of the photosensitive module 14, and the photosensitive module 14 configured to convert the environment image sensed by the photosensitive chip 141 into the video signal and transmit to the on screen display module 15, as module compositions are shown in FIG. 4.

The key 13 is configured to perform setup selection on the on screen display module 15 and input data to the on screen display module 15.

The on screen display module 15 includes a setting program 151 for setting and is configured to calculate input data according to the video signal and characteristics of the display screen 21 of the display member 20, generate the second reticle 211 that is adjustable, and stack the second reticle 211 with the video signal to be transmitted to the display member 20, as module compositions are shown in FIG. 4.

The power supply module 16 is configured to provide power for both the digital imaging member 10 and the display member 20.

The display member 20 is fixed at the eyepiece end 2032 of the telescopic sight 203 by the second fixing member 31 and electrically connected to the digital imaging member 10. The display screen 21 of the display member 20 is configured to display signals transmitted by the on screen display module 15; the keys 13 include a function key 131, an up key 132, a down key 133, a left key 134, a right key 135, and a confirmation key 136.

The on screen display module 15 is equipped with a built-in character generation chip, an on screen display is also called as OSD, which is often applied to displays such as CRTs/LCDs and other displays. The character generation chip generates some special characters or graphics to be displayed on the display screen 21, so that some information can be obtained by a user, which is mainly used to stack regularly needed information such as a camera position, a date and a time onto the video signal.

Preferably, the on screen display module 15 of the present disclosure is configured to calculate the number of pixels on the display screen 21 corresponding to the adjustment value of each grid of the first reticle 2031 of the telescopic sight 203 through the adjustment range of the first reticle 2031 of the telescopic sight 203, and generate the second reticle 211 on the display screen 21, the second reticle 211 has the same adjustment value as that of the first reticle 2031 of the telescopic sight 203. That is, the present disclosure provides the second reticle 211 on the display screen 21 that the second reticle 211 has the same adjustment value as that of the first reticle 2031, the adjustment range and an adjustment value of shooting angle of the second reticle 211 are the same as that of the first reticle 2031.

Preferably, the on screen display module 15 of the present disclosure determines a parallel aimpoint on the display screen 21 through center distances between the objective end 2033 of the telescopic sight 203 and the lens 11 of the digital imaging member 10 in the horizontal direction and in the vertical direction, the parallel aimpoint is a pixel point of the display screen 21 of the display member 20 corresponding to a sighting line of the lens 11 of the digital imaging member 10, and the sighting line of the lens 11 of the digital imaging member 10 corresponding to the pixel point is parallel to a sighting line of a crosshair center of the first reticle 2031 of the telescopic sight 203. The parallel aimpoint is configured to determine the crosshair center of the second dividing line 211. After the parallel aimpoint on the display screen 21 is determined, the position of the second reticle 211 on the display screen 21 is also determined, the second reticle 211 can be used for aiming after the adjustment value and the position of the second reticle 211 are determined.

Preferably, the on screen display module 15 of the present disclosure is configured to receive an input distance of target, and automatically compensate and generate the second reticle 211 by moving the parallel aimpoint that is on the display screen 21 in horizontal and vertical directions, respectively, by a compensation value corresponding to the input distance of target.

Since the lens 11 of the digital imaging member 10 of the auxiliary optical system of the present disclosure is offset from the objective lens 2034 of the objective end 2033, instead of being completely coincident with the objective lens 2034 of the objective end 2033, compensation is required to make an aiming position of the second reticle 211 coincide with an aiming position of the first reticle 2031, which is convenient for the shooter to aim and shoot.

Specifically, in an embodiment of the present disclosure, an automatic compensation process includes:

calculating, by the on screen display module 15, values of the number of pixels on the display screen 21 corresponding to a center distance between the objective end 2033 of the telescopic sight 203 and the lens 11 of the digital imaging member 10 in the horizontal direction, and a center distance between the objective end 2033 of the telescopic sight 203 and the lens 11 of the digital imaging member 10 in the vertical direction, according to the input distance of target; and moving the parallel aimpoint respectively in the horizontal direction and the vertical direction by the values of the number of pixels that have been calculated, to a position of a new pixel point, and generating the second reticle 211 on the display screen 21 by taking the new pixel point as the crosshair center, the second reticle 211 has the same adjustment value as that of the first reticle 2031 of the telescopic sight 203, the aiming position of each point of the second reticle 211 corresponding to the lens 11 of the digital imaging member 10 at the distance of target, and the aiming position of the same point of the first reticle 2031 of the telescopic sight 203 at the same distance of target coincide with each other.

After the automatic compensation is performed, the aiming position of each point of the second reticle 211 corresponding to the lens 11 of the digital imaging member 10 at the distance of target, and the aiming position of the same point of the first reticle 2031 of the telescopic sight 203 at the same distance of target coincide with each other. In this way, the shooter can directly use the second reticle 211 on the display screen 21 to aim at the target without converting an offset distance between the objective end 2033 and the digital imaging member 10, thereby improving aiming efficiency and conveniently using the digital imaging member 10 by the shooter.

In the auxiliary optical system of the present disclosure, since relative positions of the lens 11 of the digital imaging member 10 and the photosensitive chip 141 are fixed, positions of the video signals that have been generated on the display screen 21 of the display member 20 are also fixed. The pixel points on the display screen 21 correspond to positions of environment imaged by the lens 11 of the digital imaging member 10, that is, each pixel point on the display screen 21 of the display member 20 corresponds to the sighting line of the lens 11 of the digital imaging member 10. Therefore, the second reticle 211 generated by the on screen display module 15 of the digital imaging member 10 and displayed on the display screen 21 of the display member 20 can also have the same aiming function as the first reticle 2031 of the telescopic sight 203. Meanwhile, since the second reticle 211 displayed on the display screen 21 is calculated by the on screen display module 15 to be accurately displayed on each pixel, that is, it means that the on screen display module 15 knows the position of the signal of each pixel displayed on the display screen 21, or the on screen display module 15 can sense the position of each point where the display screen 21 displays stacked video contents; a minimum adjustment value of the aiming function of the digital imaging member 10 that can be indicated by the display screen 21 is the distance between each two points of the display screen 21, that is, the pixels of the display screen 21. Moreover, since the relative positions of the telescopic sight 203 and the digital imaging member 10 are fixed, the shooter can calibrate, adjust and set up the digital imaging member 10 on the display screen 21 of the display member 20 by means of functions of the aiming position and the shooting angle adjustment value of the first reticle 2031 of the telescopic sight 203.

A specific implementation is as follows:

Step 1: using telescopic sight 203 to find two points at a certain distance separated by a certain number of grids of the first reticle 2031, and then pixel positions of the two points are found on the display screen 21 of the display member 20, so that the on screen display module 15 obtains the number of pixels between the two points, and the number of pixels between the two points is divided by the number of corresponding grids of the first reticle 2031 of the telescopic sight 203; in this way, the number of pixels of the display screen 21 of the display member 20 corresponding to the adjustment value of each grid of the first reticle 2031 of the telescopic sight 203 can be calculated, so that the on screen display module 15 generates the second reticle 211 on the display screen 21 of the display member 20, with the adjustment value of the second reticle 211 the same as that of the first reticle 2031 of the telescopic sight 203.

Step 2: the on screen display module 15 calculates the number of pixels on the display screen 21 of the display member 20 corresponding to the center distance in the horizontal direction and the center distance in the vertical direction between the objective end 2033 of the telescopic sight 203 and the lens 11 of the digital imaging member 10 at different distance of targets, and these two pixel numbers are referred to as compensation values.

Step 3: at a certain distance finding two points which have the distance in the horizontal direction and in the vertical direction respectively the same as the center distance in the horizontal direction and the center distance in the vertical direction between the objective end 2033 of the telescopic sight 203 and the lens 11 of the digital imaging member 10; aligning a corresponding point with a point on the first reticle 2031 of the telescopic sight 203, while moving the second reticle 211 of the display screen 21 so that a point on the second reticle 211 of the display screen 21 that is the same position as that of the first reticle 2031 of the telescopic sight 203 aligns with a corresponding other point that is seen on the display screen 21. Thus, the on screen display module 15 determines a pixel position of the crosshair center of the second reticle 211 on the display screen 21, that is, a pixel point P, a sighting line of the lens 11 of the digital imaging member 10 corresponding to the pixel point P is parallel to a sighting line of the crosshair center of the first reticle 2031 of the telescopic sight 203, so the pixel point P is called as the parallel aimpoint, in this way, the on screen display module 15 generates the second reticle 211 on the display screen 21 of the display member 20 by taking the parallel aimpoint as the crosshair center thereof, the second reticle 211 having the same adjustment value as that of the first reticle 2031 of the telescopic sight 203. A distance in the horizontal direction and a distance in the vertical direction between an aiming position at the certain distance of a point on the second reticle 211 generated and an aiming position at the same distance of the same point of the first reticle 2031 of the telescopic sight 203, are the same as a center distance in the horizontal direction and a center distance in the vertical direction that are respectively between the objective end 2033 of the telescopic sight 203 and the lens 11 of the digital imaging member 10.

When the distance of target is input, the on screen display module 15 moves the parallel aimpoint on the display screen 21 of the display member 20 by corresponding compensation values of the distance of target in the horizontal direction and the vertical direction, respectively, to a position of a new pixel point, the aiming position of the lens 11 of the digital imaging member 10 at the distance of target corresponding to the new pixel point, and the aiming position of the crosshair center of the first reticle 2031 of the telescopic sight 203 at the same distance of target are coincident, the on screen display module 15 generates the second reticle 211 on the display screen 21 of the display member 20 with the new pixel point as the crosshair center, the adjustment value of the second reticle 211 is the same as that of the first reticle 2031 of the telescopic sight 203, and the aiming position of each point on the second reticle 211 corresponding to the lens 11 of the digital imaging member 10 at the distance of target, is coincident with the aiming position of the same point on the first reticle 2031 of the telescopic sight 203 at the same distance of target, that is, the second reticle 211 is generated which is the same as the first reticle 2031 of the telescopic sight 203 with the same aiming position at the same distance of target, so that the shooter can perform ballistic calculation on the target by using the second reticle 211 generated by the on screen display module 15 and displayed on the display screen 21 of the display member 20 as the same as using the first reticle 2031 of the telescopic sight 203, and then perform aiming and shooting; since the telescopic sight 203 has been sighted in, the digital imaging member 10 of the second reticle 211 which has the aiming position at the distance of target is the same as the aiming position of the first reticle 2031 of the telescopic sight 203 at the same distance of target has already been sighted in.

Figure 6:
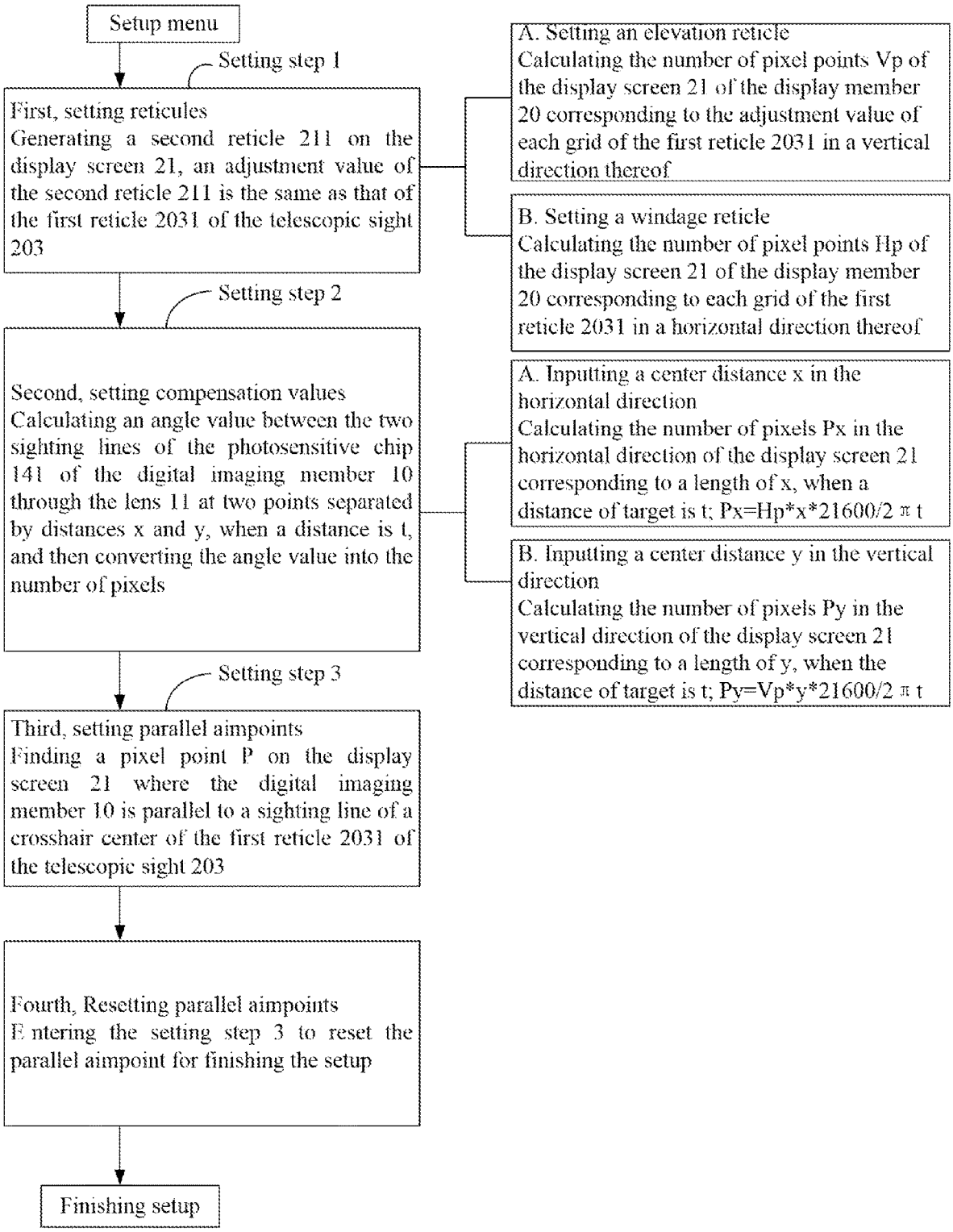
FIG. 6 is a flowchart of the auxiliary optical system of the present disclosure.

In order to implement the above functions, the auxiliary optical system of the present disclosure needs to be set as shown in FIG. 6, and includes: setting reticles, setting compensation values and setting parallel aimpoints.

Figure 7:
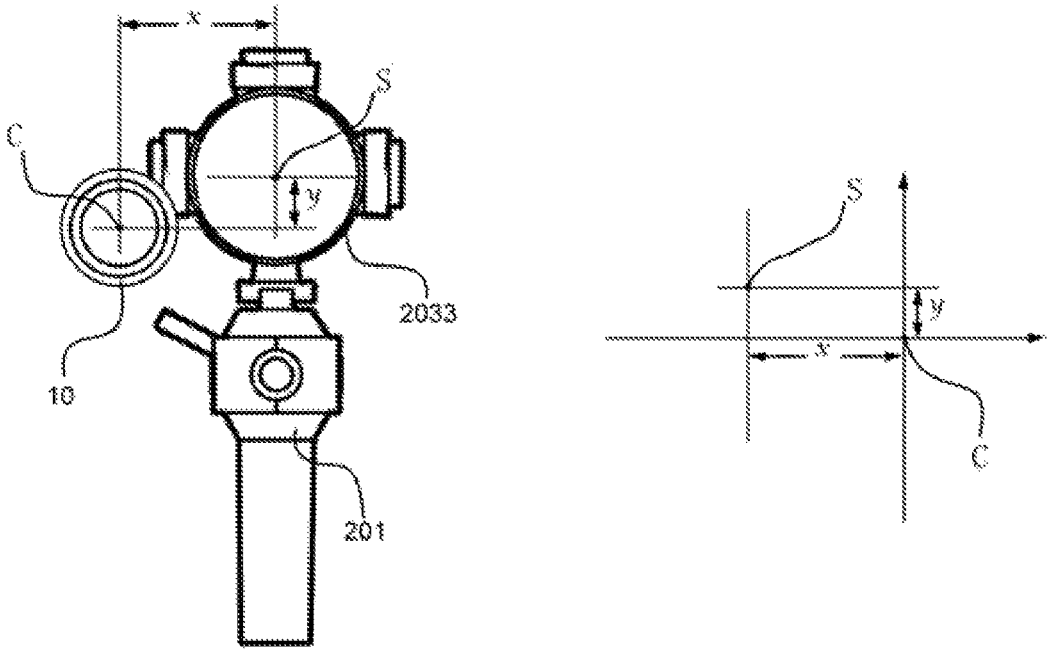
FIG. 7 is a schematic view of a center distance between a digital imaging member and an objective lens of the auxiliary optical system of the present disclosure.
Figure 8:
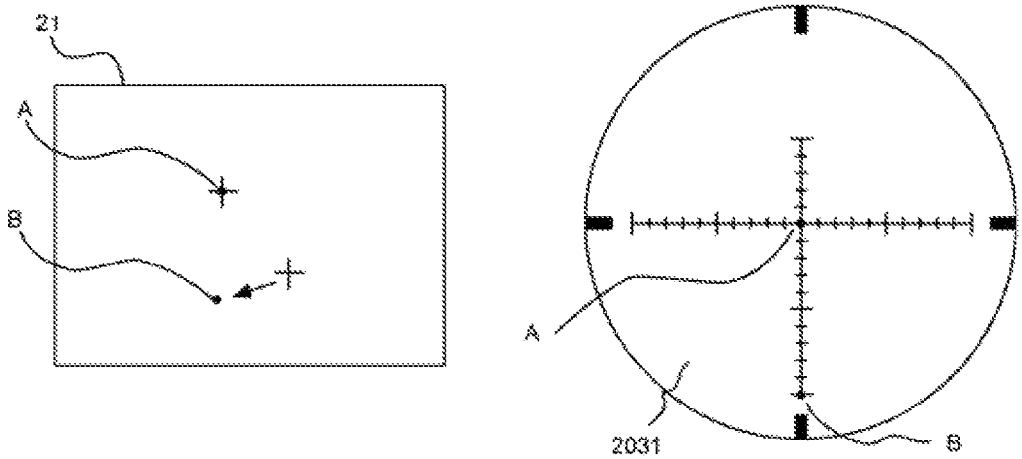
FIG. 8 is a schematic view of moving a crosshair in a setting process of the auxiliary optical system of the present disclosure.

Before the auxiliary optical system of the present disclosure is installed, the crosshair center of the first reticle 2031 of the telescopic sight 203 is aimed at a point A at a certain distance, as shown in FIG. 8, and then a position B where the lowermost scale point of the first reticle 2031 is aligned with at the same distance is marked; the crosshair center of the first reticle 2031 of the telescopic sight 203 is aimed at a point E (not shown) at a certain distance, and then a position F (not shown) where the leftmost scale point of the first reticle 2031 is aligned with at the same distance is marked. After the auxiliary optical system of the present disclosure is installed on the gun 200, it needs to be set according to setting steps by the setting program 151 of the on screen display module 15; referring to FIG. 7, first, the center distance X in the horizontal direction and the center distance Y in the vertical direction between the objective end 2033 of the telescopic sight 203 and the lens 11 of the digital imaging member 10 are measured, and the central point C of the lens 11 of the digital imaging member 10 in the sighting line direction of the telescopic sight is taken as the origin of coordinates, an upper part of a vertical coordinate axis on the origin of coordinates is a positive direction and a lower part thereof is a negative direction, a right part of a horizontal coordinate axis is the positive direction and a left part thereof is the negative direction, a horizontal coordinate value of the coordinate position of the central point S of the objective end 2033 of the telescopic sight 203 is x, and a vertical coordinate value thereof is y, and $|x|=X$, $|y|=Y$; referring to FIG. 10, two points S1 and C1 are found out from the certain distance where the telescopic sight 203 and the digital imaging member 10 can clearly see, the point C1 is taken as the origin of coordinates, the horizontal coordinate value of the point S1 is x, and the vertical coordinate value of the point S1 is y, and then the key 131 is pressed and hold some time, so that a setting menu is seen on the display screen 21 of the display member 20.

The setting menu includes: 1. setting reticles, 2. setting compensation values, 3. setting parallel aimpoints, 4. resetting parallel aimpoints, and 5. exiting the setting.

Setting step 1, pressing the up key 132 or the down key 133 to select, and then pressing the confirmation key 136 to enter an option of "1. setting reticles" in the menu, at this time, the display screen 21 of the display member 20 displays "setting an elevation reticle, please input the number of grids of the elevation reticle 【 】", pressing the up key 132, the down key 133, the left key 134 and the right key 135 to input the number of scale grids Uv of the first reticle 2031 of the telescopic sight 203 from the crosshair center to the lowermost scale point in the brackets, which is usually 10 grids, and then pressing the confirmation key 136 to enter a next step, at this time, two crosshairs are seen on the display screen 21 of the display member 20; then pressing the up key 132, the down key 133, the left key 134 and the right key 135 to move the crosshair center of one of the two movable crosshairs seen on the display screen 21 of the display member 20 to the position of the point A seen on the display screen 21, at this time, a position corresponding to the crosshair center of the crosshair is a pixel point Va on the display screen 21, pressing the confirmation key 136, and then, moving the crosshair center of the other movable crosshair seen on the display screen 21 of the display member 20 to the position of the point B seen on the display screen 21, at this time, the position corresponding to the crosshair center of the crosshair is a pixel Vb on the display screen 21, pressing the confirmation key 136 to completely setting of this step thereof. When the setting steps are completed, the on screen display module 15 obtains the number of pixels Pv between the pixel Va and the pixel Vb on the display screen 21, the number of pixels Pv indicates an angle value between a sighting line of the photosensitive chip 141 of the digital imaging member 10 through the lens 11 at the point A and another sighting line of the photosensitive chip 141 of the digital imaging member 10 through the lens 11 at the point B, it is the same as the adjustment value or the angle value between a sighting line of crosshair center of the first reticle 2031 of the telescopic sight 203 at the point A and another sighting line of the lowermost scale point of the first reticle 2031 at the point B, the number of pixels Pv is divided by the number of grids Uv from the crosshair center to the lowermost scale point of the first reticle 2031 of the telescopic sight 203 that have been input in the previous step, the number of pixels Vp of the display screen 21 of the display member 20 corresponding to the adjustment value of each grid of the first reticle 2031 in the vertical direction can be calculated; at this time, the on screen display module 15 can generate a vertical reticle on the display screen 21 of the display member 20 with a pixel Cc at the center of the screen as the crosshair center and each grid per Vp points in the vertical direction, and the adjustment value of each grid of the vertical reticle is the same as that of each grid of the first reticle 2031 of the telescopic sight 203 in the vertical direction.

Then, entering a next setting step, the display screen 21 of the display member 20 displays "setting a windage reticle, please input the number of grids of the windage reticle 【 】", pressing the up key 132, the down key 133, the left key 134 and the right key 135 to input the number of scale grids Uh of the first reticle 2031 of the telescopic sight 203 from the crosshair center to the leftmost scale point in the brackets, which is usually 10 grids, and then pressing the confirmation key 136 to enter a next step, at this time, two crosshairs are seen on the display screen 21 of the display member 20; moving the crosshair center of one of the two movable crosshairs seen on the display screen 21 of the display member 20 to a position of a point E seen on the display screen 21, at this time, a position corresponding to the crosshair center of the crosshair is a pixel point He on the display screen 21, pressing the confirmation key 136, and then, moving the crosshair center of the other movable crosshair seen on the display screen 21 of the display member 20 to a position of a point F seen on the display screen 21, at this time, the position corresponding to the crosshair center of the crosshair is a pixel Hf on the display screen 21, pressing the confirmation key 136 to complete the setting steps and return to the setting menu. When the setting steps are completed, the on screen display module 15 obtains the number of pixels Ph between the pixel He and the pixel Hf on the display screen 21, the number of pixels Ph indicates an angle value between a sighting line of the photosensitive chip 141 of the digital imaging member 10 through the lens 11 at the point E and another sighting line of the photosensitive chip 141 through the lens 11 at the point F, it is the same as the adjustment value or the angle value between a sighting line of the crosshair center of the first reticle 2031 of the telescopic sight 203 at the point E and another sighting line of the leftmost scale point of the first reticle 2031 at the point F, the number of pixels Pf is divided by the number of grids Uf from the crosshair center to the leftmost scale point of the first reticle 2031 of the telescopic sight 203 that have been input in the previous step, the number of pixels Hp of the display screen 21 of the display member 20 corresponding to the adjustment value of each grid of the first reticle 2031 in the horizontal direction can be calculated; at this time, the on screen display module 15 can generate a horizontal reticle on the display screen 21 of the display member 20 with a pixel Cc at the center of the screen as the crosshair center and each grid per Hp points in the horizontal direction, and the adjustment value of each grid of the horizontal reticle is the same as that of each grid of the first reticle 2031 of the telescopic sight 203 in the horizontal direction. A reason why the horizontal direction and the vertical direction are calculated separately is that the distances between the horizontal and vertical directions of the pixel points of the display screen 21 of the display member 20 are not necessarily the same. After the option of "1. setting reticle" in the menu is completed, the on screen display module 15 generates the second reticle 211 by taking the pixel point Cc at the center of the screen as the crosshair center thereof, its the adjustment value of shooting angle to the gun 200 is identical to the first reticle 2031 of the telescopic sight 203.

Figure 9:
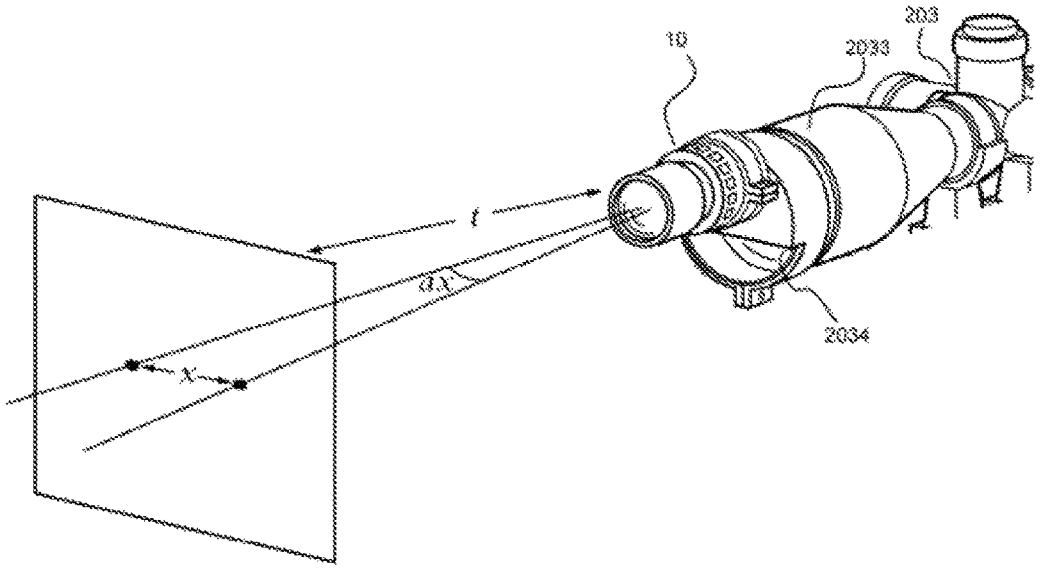
FIG. 9 is a schematic view of setting a compensation value in the setting process of the auxiliary optical system of the present disclosure.

Setting step 2, selecting to enter an option of "2. setting compensation values" in the menu, at this time, the display screen 21 of the display member 20 displays "please input a horizontal coordinate value 【】", pressing the up key 132, the down key 133, the left key 134 and the right key 135 to input the horizontal coordinate value x of the coordinate position of the central point S of the objective end 2033 of the telescopic sight 203 in the brackets, by taking the central point C of the lens 11 of the digital imaging member 10 in the sighting line direction of the telescopic sight 203 as the origin of coordinates, then pressing the confirmation key 136 to proceed to a next step, at this time, the display screen 21 of the display member 20 displays "please input a vertical coordinate value 【】", inputting the vertical coordinate value y of the coordinate position of the central point S of the objective end 2033 of the telescopic sight 203 in the brackets, by taking the central point C of the lens 11 of the digital imaging member 10 in the sighting line direction of the telescopic sight 203 as the origin of coordinates, and then pressing the confirmation key 136 to complete the setting steps and return to the setting menu. When the setting steps are completed, the on screen display module 15 obtains the horizontal coordinate value x and the vertical coordinate value y, when a distance t of the target is known, the angle value ax between the two sighting lines of the photosensitive chip 141 of the digital imaging member 10 through the lens 11 at the two points separated by a distance x can be calculated when the distance is t, referring to FIG. 9, that is, the number of pixels Px in the horizontal direction of the display screen 21 of the display member 20.

A calculation process is as follows: it is assumed that an value of each grid of the first reticle 2031 of the telescopic sight 203 is 1 MOA (minute of angle), 1 MOA is 1/60 of 1 degree, that is, the circumference $2\pi t$ at with a radius of t is divided into 21600 parts, and a length of each part corresponds to the value $2\pi t/21600$ that is each grid of the first reticle 2031 of the telescopic sight 203, since a radius of an arc is much greater and a length of the arc is much smaller, so that a difference formed between a linear distance between the two points, and an arc distance between the two points can be negligible; in this way, when the distance is t, the angle value ax between the two sighting lines of the photosensitive chip 141 of the digital imaging member 10 through the lens 11 at the two points separated by the distance x is: $ax=x/(2\pi t/21600)=x*21600/2\pi t$, that is, the number of pixels Px in the horizontal direction of the display screen 21 of the display member 20 is: $Px=Hp*x*21600/2\pi t$; and at the same time, the angle value between the two sighting lines of the photosensitive chip 141 of the digital imaging member 10 through the lens 11 at the two points separated by the distance y can be calculated, when the distance is t, that is, the number of pixels Py in the vertical direction of the display screen 21 of the display member 20 is: $Py=Vp*y*21600/2\pi t$. Since the values of Hp, x, Vp, and y have been obtained by the on screen display module 15, the on screen display module 15 can calculate Px and Py, which are called compensation values, as long as the distance t of the target is known.

Figure 10:
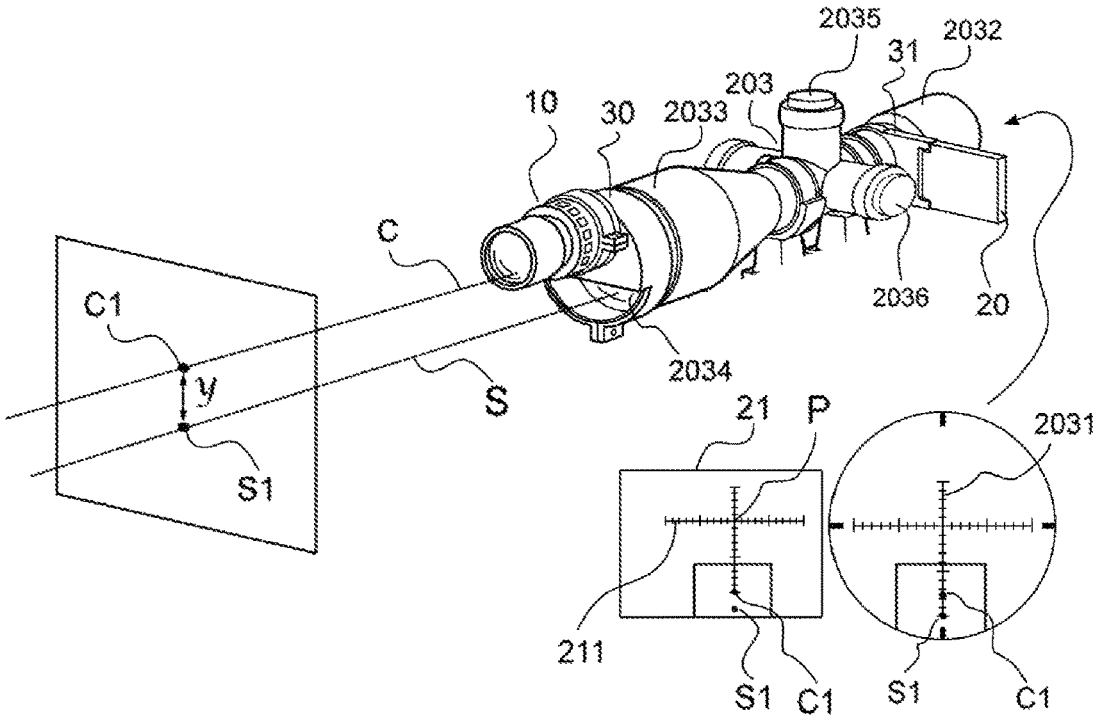
FIG. 10 is a schematic view of setting parallel aimpoints in the setting process of the auxiliary optical system of the present disclosure.

Setting step 3, selecting to enter an option of "3. setting parallel aimpoints" in the menu, at this time, the second reticle 211 that is completed by the above-mentioned setting step 1 appears on the display screen 21 of the display member 20, at this time, a point on the first reticle 2031 of the telescopic sight 203 is aligned with the point S1, pressing the up key 132, the down key 133, the left key 134 and the right key 135 to move a point at the same position of the second reticle 211 that is seen on the display screen 21 of the display member 20 to the position of the point C1 that is seen on the display screen 21, the position of one point of the second reticle 211 is determined, the position of the crosshair center of the second reticle 211 is naturally determined, which corresponds to the position of a pixel point P on the display screen 21; referring to FIG. 10, it demonstrates the case that the crosshair center of the objective end 2033 of the telescopic sight 203 and the crosshair center of the lens 11 of the digital imaging member 10 are aligned in a straight line in the vertical direction, that is, the center distance in the horizontal direction x=0. In actual use, in order to make it more convenient to use or install other equipments, the crosshair center of the objective end 2033 of the telescopic sight 203 and the crosshair center of the lens 11 of the digital imaging member 10 can be aligned in different directions.

After the movement is completed, pressing the confirmation key 136 to complete the setting and return to the setting menu, and at this time, the on screen display module 15 obtains the position of the pixel P on the display screen 21, which corresponds to a point on the photosensitive chip 141 of the photosensitive module 14 of the digital imaging member 10, and the sighting line that is formed at this point passing through the lens 11 of the digital imaging member 10 is parallel to the sighting line of the crosshair center of the first reticle 2031 of the telescopic sight 203, therefore, at the same distance, the distance between the position of the target that has been seen on the pixel point P, and the position of the target that has been seen by the crosshair center of the first reticle 2031 of the telescopic sight 203 in the horizontal direction is X, and the distance in the vertical direction is Y, and the pixel point P is called as the parallel aimpoint.

After completing the settings of the above three steps, the settings are completed. When the auxiliary optical system that has been completed setting is removed from the gun 200 after being used, and then re-installed to be used again, except that the parallel aiming point P may be displaced, other data are the same. Therefore, the above setting step 3 is re-performed by selecting an option of "4. resetting parallel aimpoints" in the menu, pressing the confirmation key 136 to complete the setting and return to the setting menu. At this time, the on screen display module 15 obtains the position of a new pixel P on the display screen 21, that is, the setting process is completed by setting the parallel aimpoint, so that the auxiliary optical system that has been reset can be put into use quickly and conveniently.

After the setup is completed, the on screen display module 15 generates the second reticle 211 on the display screen 21 of the display member 20 by taking the parallel aimpoint as the center thereof, the second reticle 211 having the same adjustment value as that of the first reticle 2031 of the telescopic sight 203. A distance in the horizontal direction and a distance in the vertical direction between an aiming position of each point of the second reticle 211 generated on a target at the certain distance and a corresponding aiming position of the same point of the first reticle 2031 of the telescopic sight 203 on the target at the same distance, are the same as the center distance in the horizontal direction and the center distance in the vertical direction that are between the objective end 2033 of the telescopic sight 203 and the lens 11 of the digital imaging member 10. At this time, the second reticle 211 is ready for aiming, but is somewhat inconvenient to calculate the ballistic trajectory.

In order to obtain a better second reticle 211, pressing and releasing the function key 131 to enter a working state thereof, pressing the up key 132, the down key 133, the left key 134 and the right key 135 to input the distance t of the target and then pressing the confirmation key 136, the on screen display module 15 can calculate the compensation values Px and Py according to the formulas: $Px=Hp*x*21600/2\pi t$ and $Py=Vp*y*21600/2\pi t$; on the display screen 21 of the display member 20, moving the pixel point P horizontally with the compensation value Px and vertically with the compensation value Py with the pixel point P as the origin of coordinates to a point Pt; the aiming position of the lens 11 of the digital imaging member 10 at the distance of target corresponding to the point Pt, and the aiming position of the crosshair center of the first reticle 2031 of the telescopic sight 203 at the same distance of target are coincident, the on screen display module 15 generates the second reticle 211 on the display screen 21 of the display member 20 with the new pixel point Pt as the crosshair center thereof, the adjustment value of the second reticle 211 is the same as that of the first reticle 2031 of the telescopic sight 203, and the aiming position of each point on the second reticle 211 corresponding to the lens 11 of the digital imaging member 10 at the distance of target, and the aiming position of the same point on the first reticle 2031 of the telescopic sight 203 at the same distance of target are coincident, that is, the second reticle 211 is generated which is the same as the first reticle 2031 of the telescopic sight 203 with the same aiming position at the same distance of target, so that the shooter can perform ballistic calculation on the target by using the second reticle 211 generated by the on screen display module 15 and displayed on the display screen 21 of the display member 20 as well as using the first reticle 2031 of the telescopic sight 203, and then perform aiming shooting. In this way, the shooter can realize the functions of the digital sight under special environmental conditions such as low-illumination conditions by using the auxiliary optical system of the present disclosure without replacing the telescopic sight 203, can silently sight in in windy or windless environments without live ammunition shooting, can complete adjustment quickly, can allow the shooter to use the same ballistic trajectory calculation as the telescopic sight 203 and use the same aimpoint as the first reticle 2031 of the telescopic sight 203 to aim and shoot, and greatly improves convenience and the efficiency of use thereof.

The auxiliary optical system of the present disclosure can greatly reduce the area of the digital imaging member protruding on the contour line of the front view direction of the gun 200 by partially overlapping the digital imaging member 10 and the objective lens 2034 of the telescopic sight 203, the shooter can calibrate the digital imaging member 10 by using functions of the conventional telescopic sight; meanwhile, the gun provided with the auxiliary optical system of the present disclosure can implement functions of the digital sight under special environmental conditions such as low-illumination conditions without replacing the telescopic sight 203, can be silently sighted in in windy or windless environments without live ammunition shooting, can complete adjustment quickly, can allow the shooter to use the same ballistic trajectory calculation as the telescopic sight and use the same aimpoint as the first reticle of the telescopic sight to aim and shoot, and greatly improves convenience and the efficiency of use thereof.

Although the features and elements of the present disclosure are described as embodiments above, it can be understood that the above embodiments are illustrative and intended to be used to explain the present disclosure, rather than being construed as a limitation of the present disclosure. Any variation or replacement made by one of ordinary skill in the related art without departing from the spirit of the present disclosure shall fall within the protection scope of the present disclosure.

What is claimed is:

1. An auxiliary optical system installed on a telescopic sight of a gun, the telescopic sight comprising an eyepiece end, an objective end and a first reticle seen from the eyepiece end, an eyepiece installed on the eyepiece end, and an objective lens installed on the objective end, the auxiliary optical system comprising:

a digital imaging member, a display member, a first fixing member and a second fixing member, the digital imaging member fixed at the objective end by the first fixing member and partially shielding the objective lens, so that the digital imaging member and the objective end are partially overlapped in a line of sight direction of the telescopic sight;

the display member fixed at the eyepiece end by the second fixing member and electrically connected to the digital imaging member, the display member comprising a display screen;

the digital imaging member configured to perform photosensitive imaging on an environmental image and convert the environmental image into a video signal, generate a second reticle that is adjustable and has the same function as the first reticle, and stack the second reticle with the video signal and then transmit to the display member for display;

the digital imaging member comprising an on screen display module, the on screen display module comprising a setting program for setting and configured to calculate input data according to the video signal and characteristics of the display screen of the display member, generate the second reticle that is adjustable, and stack the second reticle on the video signal to be transmitted to the display member; and wherein the on screen display module determines a parallel aimpoint on the display screen through center distances between the objective end of the telescopic sight and a lens of the digital imaging member in a horizontal direction and in a vertical direction, the parallel aimpoint is a pixel point of the display screen of the display member corresponding to a sighting line of the lens of the digital imaging member, and the sighting line of the lens of the digital imaging member corresponding to the pixel point is parallel to a sighting line of a crosshair center of the first reticle of the telescopic sight.

2. The auxiliary optical system as claimed in claim 1, wherein an adjustment value of the second reticle is the same as that of the first reticle.

3. The auxiliary optical system as claimed in claim 1, wherein an aiming position of a target at a certain distance corresponding to a point of the second reticle coincides with an aiming position of the target at the same distance corresponding to the same point of the first reticle.

4. The auxiliary optical system as claimed in claim 1, wherein the first fixing member comprises a first fixing ring, a second fixing ring, and an overlapping cover, the first fixing ring installed on the objective end of the telescopic sight, the digital imaging member mounted in the second fixing ring, one surface of the overlapping cover connected to an outer edge portion of the first fixing ring and partially shielding an inner ring of the first fixing ring, so as to partially shielding the objective lens of the telescopic sight, and the other surface of the overlapping cover connected to the second fixing ring, so that the digital imaging member and the objective end of the telescopic sight are partially overlapped in the line of sight direction of the telescopic sight.

5. The auxiliary optical system as claimed in claim 1, wherein the digital imaging member further comprises the lens, a housing, a key, a photosensitive module and a power supply module;

all the photosensitive module, the on screen display module and the power supply module arranged in the housing, the lens arranged at a front end of the housing, and the key arranged on the housing;

the photosensitive module comprising a photosensitive chip, the lens configured to image the environment image on the photosensitive chip of the photosensitive module, and the photosensitive module configured to convert the environment image sensed by the photosensitive chip into the video signal and transmit to the on screen display module;

the key configured to perform setup selection on the on screen display module and input data to the on screen display module; and the power supply module configured to provide power for both the digital imaging member and the display member.

6. The auxiliary optical system as claimed in claim 1, wherein the on screen display module is configured to calculate the number of pixels on the display screen corresponding to an adjustment value of each grid of the first reticle of the telescopic sight through an adjustment range of the first reticle of the telescopic sight, and generate the second reticle, the second reticle having the same adjustment value as that of the first reticle of the sight.

7. The auxiliary optical system as claimed in claim 1, wherein the on screen display module is configured to automatically compensate and generate the second reticle by moving the parallel aimpoint that is on the display screen in horizontal and vertical directions, respectively, by a compensation value corresponding to an input distance of target.

8. The auxiliary optical system as claimed in claim 7, wherein the display member is rotationally connected to the second fixing member to fold or unfold the display member.

9. The auxiliary optical system as claimed in claim 1, wherein an automatic compensation process comprises:

calculating, by the on screen display module, values of the number of pixels on the display screen corresponding to a center distance between the objective end of the telescopic sight and the lens of the digital imaging member in the horizontal direction, and a center distance between the objective end of the telescopic sight and the lens of the digital imaging member in the vertical direction, according to the input distance of target; and moving the parallel aimpoint respectively in the horizontal direction and the vertical direction by the values of the number of pixels that have been calculated, to a position of a new pixel point, and generating the second reticle with the same adjustment value as the first reticle of the telescopic sight on the display screen by taking the new pixel point as a crosshair center, an aiming position of each point on the second reticle corresponding to the lens of the digital imaging member at the distance of target, and an aiming position of the same point on the first reticle of the telescopic sight at the same distance of target coincide with each other.

* * * * *